US005162806A

United States Patent [19]

Monser

[11] Patent Number: 5,162,806

[45] Date of Patent: Nov. 10, 1992

[54] PLANAR ANTENNA WITH LENS FOR CONTROLLING BEAM WIDTHS FROM TWO PORTIONS THEREOF AT DIFFERENT FREQUENCIES

[75] Inventor: George J. Monser, Goleta, Calif.

[73] Assignee: Raytheon Company, Lexington, Mass.

[21] Appl. No.: 475,472

[22] Filed: Feb. 5, 1990

[51] Int. Cl.[5] ..... H01Q 1/36; H01Q 19/06

[52] U.S. Cl. ..... 343/753; 343/895

[58] Field of Search ..... 343/895, 753, 911 R, 343/789

[56] References Cited

U.S. PATENT DOCUMENTS

| | | | |
|---|---|---|---|
| 2,547,416 | 4/1951 | Skellett | 343/753 |
| 3,192,531 | 6/1965 | Cox et al. | 343/789 |
| 3,686,674 | 8/1972 | Clasby et al. | 343/895 |
| 3,745,585 | 7/1973 | Barbano | 343/895 |
| 4,387,379 | 6/1983 | Hardie | 343/895 |
| 4,573,212 | 2/1986 | Lipsky | 343/895 |
| 4,608,572 | 8/1986 | Blakney et al. | 343/895 |

FOREIGN PATENT DOCUMENTS

| | | | |
|---|---|---|---|
| 1189162 | 3/1965 | Fed. Rep. of Germany | 343/895 |

OTHER PUBLICATIONS

"Modern Antenna Design"; Thomas A. Milligan; Martin Marietta Denver Aerospace; McGraw-Hill Book Co.; pp. 372-383.

*Primary Examiner*—Michael C. Wimer

*Attorney, Agent, or Firm*—Judith A. Caplan; Richard M. Sharkansky

[57] ABSTRACT

A low cost, broadband, broadbeam antenna. The radiating elements of the antenna are two spiral conductors mounted over a cavity. Inside the cavity, strips of RF absorber and a metal shim are located. Resistive damping at the ends of the sprial conductors is provided by discrete resistors. A dielectric lens covers the spiral conductors.

4 Claims, 3 Drawing Sheets

PLANAR ANTENNA WITH LENS FOR CONTROLLING BEAM WIDTHS FROM TWO PORTIONS THEREOF AT DIFFERENT FREQUENCIES

BACKGROUND OF THE INVENTION

This antenna relates generally to antennas for receiving or transmitting radio frequency energy and more particularly to broadband antennas which fit into relatively small volumes.

Antennas are widely used in many types of systems. The structure of the antenna affects its operating characteristics. As a result, antennas take on a variety of shapes. The particular shape is selected to meet the requirements of any system.

For certain systems, it is desirable to construct a broadband, circularly-polarized antenna which transmits or receives a beam of radio frequency energy over a wide angular range (i.e., a broad-beam antenna). The antenna must be relatively small and have a low manufacturing cost. Further, when many antennas are made, each should have substantially the same performance characteristics.

One type of broadband, circularly-polarized, broad-beam antenna is the spiral antenna. A spiral antenna contains two conductive traces formed into two interlocking spirals on a surface. The surface could be flat or cone shaped.

A cone shaped antenna provides greater directivity in the direction of the apex of the cone. However, cone shaped anennas are generally more difficult and costly to manufacture than flat spirals.

Known modifications to the basic spiral structure increase the bandwidth of the antenna. In one modification, the cavity behind a flat spiral is a constant depth and is filled with a material which absorbs RF energy. This structure increases the bandwidth but reduces the gain of the antenna. However, for small antennas (diameters less than one-half wavelength) with no absorber in the cavity, the gain is not reduced. Nevertheless, this technique provides only about a 2:1 bandwidth and does not provide bandwidths of 3:1 needed for some applications.

In another modification, the cavity is made cone shape so that it is deeper behind the center of the spiral. Such an antenna can operate over a 3:1 frequency range and has better gain, but at the upper frequencies in the range has a narrower coverage angle.

An additional problem exists with spiral antennas. The ends of the sprials must be coated with some form of material which absorbs RF energy to eliminate reflections from the ends of the spirals. When many antennas are produced, precise manufacturing techniques must be used to ensure that the absorber has the same thickness and dimensions on all such antennas. The precise techniques are costly to employ but if not followed, will result in variations in performance from antenna to antenna.

SUMMARY OF THE INVENTION

With the foregoing background in mind, it is an object of this invention to provide a small, broadband, wide angle antenna.

It is a further object to provide an antenna which can be inexpensively and repeatably manufactured.

The foregoing and other objects are achieved by a spiral antenna backed by a cone shaped cavity. The ends of the spirals are connected to discrete resistors for damping. The floor of the cavity contains a plurality of strips of RF absorber. A conducting shim is mounted in the cavity above the apex of the cone shaped cavity. A dielectric lens is mounted over the spiral antenna.

BRIEF DESCRIPTION OF THE DRAWINGS

The invention will be better understood by reference to the following detailed description and accompanying drawings, in which.

DESCRIPTION OF THE PREFERRED EMBODIMENTS

Figure 1:
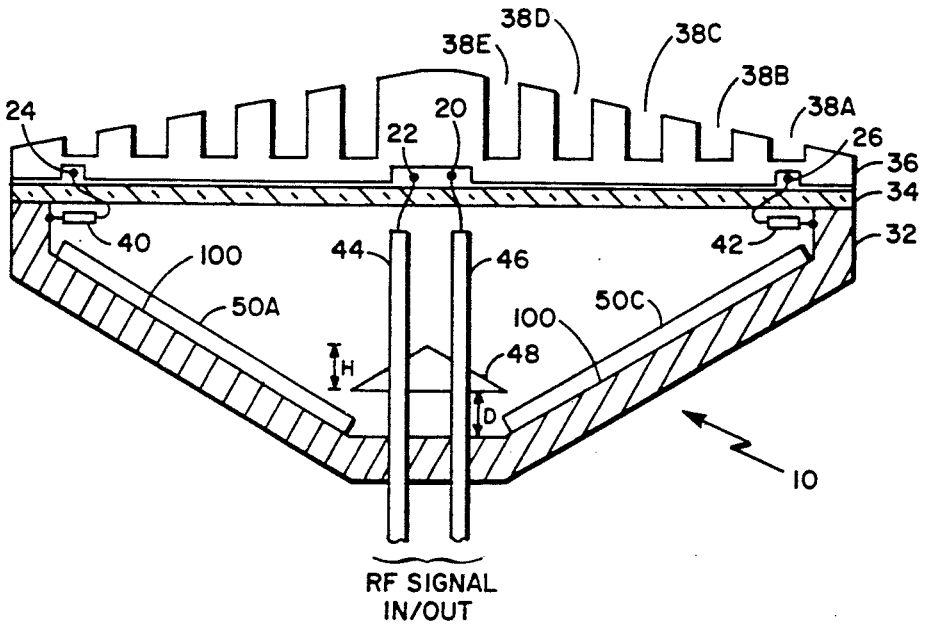
FIG. 1 is a cross-sectional view of an antenna constructed according to the invention.
Figure 2A:
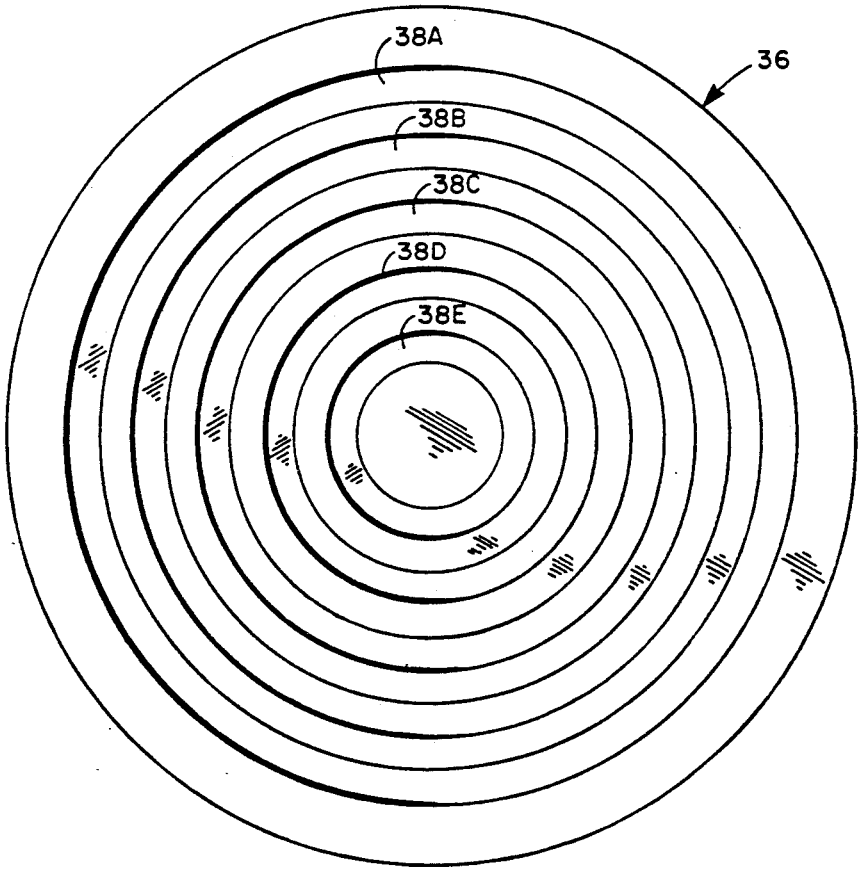
FIG. 2A is a top view of the antenna of FIG. 1.
Figure 2C:
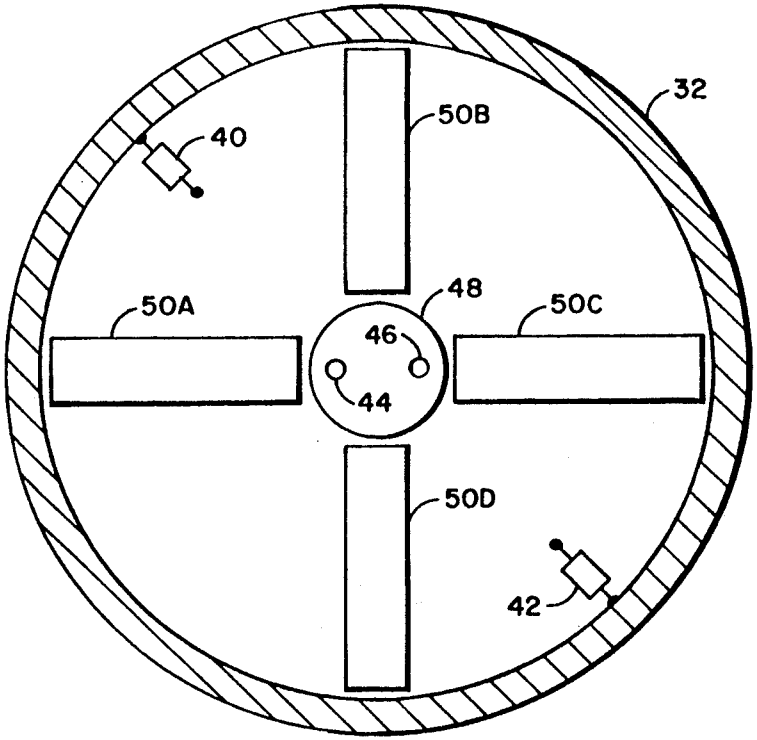
FIG. 2C is a top view of the antenna of FIG. 1 with lens 36 and dielectric plate 34 removed.
Figure 2B:
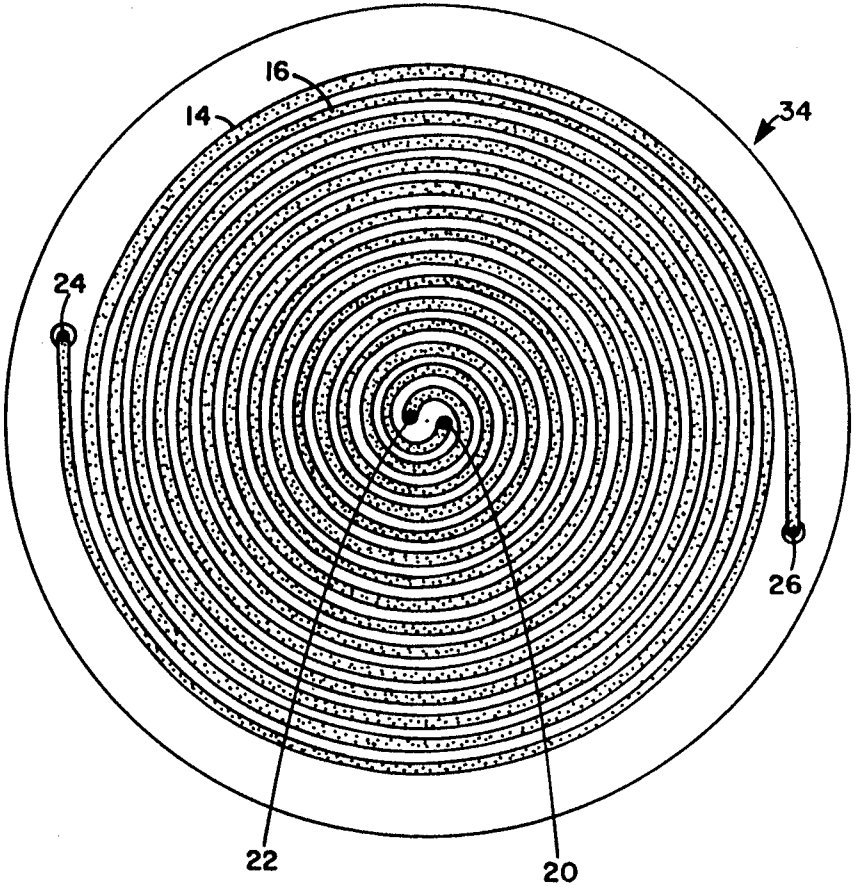
FIG. 2B is a top view of the antenna of FIG. 1 with lens 36 removed.

FIG. 1 shows a cross-section of an antenna constructed according to the invention. Two spirals 14 and 16 (FIG. 2) of conductive material are patterned into dielectric plate 34. Techniques for forming such spirals are well known in the art.

The centers of the spirals are connected at points 20 and 22 to RF input or output lines (not numbered). Such connections are well known in spiral antennas and are often made through a balun (not shown). The RF input or output lines (not numbered) pass through posts 44 and 46 where they are connected to other circuitry in the RF system (not shown).

The distal ends of the spirals 14 and 16 (FIG. 2) are connected to resistors 40 and 42 at points 24 and 26, respectively. Resistors 40 and 42 are connected to case 32, which is at ground potential. Resistors 40 and 42 are resistors of approximately 130 ohms. Resistors 40 and 42 are used in place of resistive coating on spirals 14 and 16 (FIG. 2) such as might be found in the prior art.

Spirals 14 and 16 (FIG. 2) are the radiating elements of antenna 10. Spirals 14 and 16 are covered by lens 36. Lens 36 is constructed from a dielectric material using known techniques. As seen more clearly in FIG. 2A, lens 36 contains a plurality of serrations 38A . . . 38E. Lens 36 broadens the beamwidth of antenna 10. Also, lens 36 tends to reduce variations in RF energy transmitted by antenna 10 over the beamwidth of the antenna. This smoothing reduces variations of the gain of the antenna as a function of angle relative to the boresight of the antenna.

Serrations 38A . . . 38E tend to reduce the effective dielectric constant of lens 36. For example, material with a dielectric constant in the range of 2 to 3 could be changed to have an effective dielectric constant of approximately 1.5. As the dielectric constant decreases, the lens tends to broaden the beam to a lesser extent. It is possible to change the shape of the lens to achieve the same result. However, the shape of lens 36 will likely be determined, at least in part, empirically. It is much easier to make the many measurements needed for empirical determination by cutting serrations into the lens than to reshape the lens.

Other shaped lenses could be used. FIG. 3A shows a top view of one such alternative lens 236 in outline form. Lens 236 is constructed from a suitable dielectric, such as the synthetic resin polymer sold under the trade name Teflon®. The contours of the lens can be more readily seen in the cross-section shown in FIG. 3B.

Lens 236 has serrations 250 along its edges. These serrations fall in the peripheral region 252 of the lens. In the peripheral region, the lens is therefore partially dielectric and partially air. The effective dielectric constant in the peripheral region is somewhat between the dielectric constant of air and of the dielectric used to make the lens. Therefore, the dielectric constant is less near the periphery of the lens than at its center. The lower dielectric constant near the periphery prevents the lens from overly broadening the beam.

Lens 236 is shown with a cavity 254. When mounted over a spiral antenna, cavity 254 provides space for connections to the antenna such as at points 20 and 22 (FIG. 1).

Turning again to FIG. 1, it can be seen that spirals 14 and 16 are backed by a cavity 100 formed by case 32. Cavity 100 is generally cone shaped, with the apex at the center. Here, the walls of the cavity slope at approximately 28° relative to the horizontal and the cavity has a depth of approximately 0.4 wavelengths of the highest operating frequency.

Along the floor of cavity 100, strips of RF absorber 50A . . . 50D are mounted, such as by gluing. In the cross-section of FIG. 1, strips 50A and 50C are visible. In the top view of FIG. 2C, four strips of absorber 50A . . . 50D are visible. Strips of absorber 50A . . . 50D are spread across enough of the floor of cavity 100 to reduce cavity reflection effects and prevent radiated signals from exciting high order modes in the cavity. However, the amount of absorber must be limited so that the antenna gain is not unduly restricted. Here, the absorber strips are approximately 1/16 of an inch thick and ¼ inch wide. The strips cover less than 25% of the floor area of the cavity and occupy less than 15% of the volume of cavity 100.

Figure 3C:
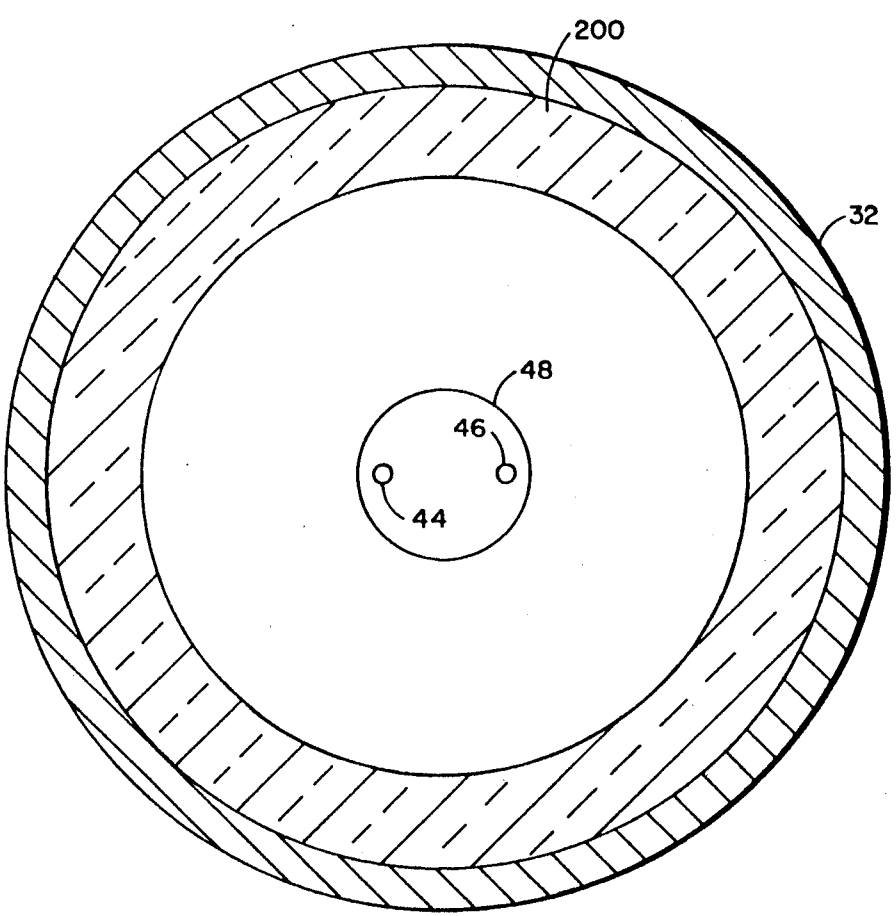
FIG. 3C is a top view of an alternative embodiment of the antenna with lens 36 and dielectric plate 34 removed.
Figure 3A:
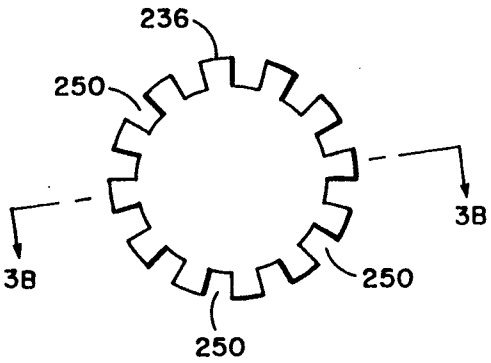
FIG. 3A is a top view of the antenna of FIG. 1 with an alternative lens.
Figure 3B:
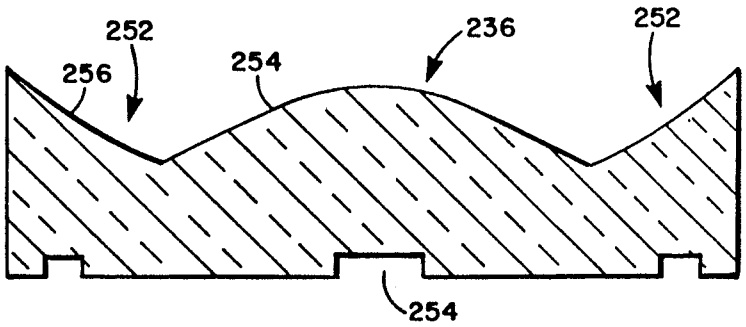
FIG. 3B is a cross-section of the alternative lens of FIG. 3A taken along the line 3B—3B.

FIG. 3C shows an alternative arrangement of RF absorber. In FIG. 3B, RF absorber is formed into a ring 200.

FIG. 1 and FIG. 3 show a cone shaped shim 48 along the center line of cavity 100. Here, the angle of the cone is approximately 120° and the base of the cone is approximately 0.3 wavelengths at the upper operating frequency. Shim 48 is fabricated from any known conducting material. Shim 48 is secured, such as with solder or conductive epoxy, to posts 44 and 46. Shim 48 is a distance D above the floor of cavity 100. The distance D is selected to fine tune the antenna pattern at the upper operating frequency. The placement of shim 48 principally affects the performance of antenna 10 near its upper operating frequency.

Having described embodiments of this invention, it will be apparent to one of skill in the art that various alternative embodiments can be made. Spirals 14 and 16 need not be Archimedian spirals, as shown, but could be log periodic spirals. The size, placement, and even the number of strips of absorber 50A . . . 50D could be varied. As another alternative, resistors 40 and 42 could be mounted outside of cavity 100.

It is felt, therefore, that this invention should be limited only by the spirit and scope of the appended claims.

What is claimed is:

1. In an antenna adapted to radiate a beam of radio frequency energy of the type having two conductors disposed on a flat surface, said conductors arranged to radiate higher frequencies from a first portion of the flat surface and lower frequencies from a second portion of the flat surface, an improvement comprising:

means for broadening the beam of radio frequency energy radiated from the first portion by a first amount and for broadening the beam of radio frequency energy radiated from the second portion by a second amount, wherein the first amount is greater than the second amount.

2. The antenna of claim 1 wherein the means for broadening comprises a piece of dielectric material mounted to the flat surface.

3. The antenna of claim 2 wherein the dielectric material is thicker over the first portion than over the second portion.

4. The antenna of claim 2 wherein the piece of dielectric material over the second portion of the flat surface has serrations formed therein.

* * * * *